US005493383A

United States Patent [19]

Pozniakas et al.

[11] Patent Number: 5,493,383

[45] Date of Patent: Feb. 20, 1996

[54] SEQUENCED CLEANER RETRACTION METHOD AND APPARATUS

[75] Inventors: Robert S. Pozniakas, Rochester; David E. Rollins, Lyons; Bruce E. Thayer, Webster, all of N.Y.

[73] Assignee: Xerox Corporation, Stamford, Conn.

[21] Appl. No.: 342,284

[22] Filed: Nov. 18, 1994

[51] Int. Cl.[6] ..... G03G 21/00

[52] U.S. Cl. ..... 355/301; 15/256.5

[58] Field of Search ..... 355/296, 301; 198/496; 15/256.5–256.53

[56] References Cited

U.S. PATENT DOCUMENTS 4,669,864 6/1987 Shoji et al. ..... 355/297

FOREIGN PATENT DOCUMENTS 4203596 8/1992 Germany ..... 355/301

*Primary Examiner*—William J. Royer
*Attorney, Agent, or Firm*—T. L. Fair

[57] ABSTRACT

An apparatus and method using eccentrics, driven by a two-level gear, to sequentially retract and engage the brushes in the non-imaging region of the photoreceptor surface. The first brush, in the direction of motion of the photoreceptor, is brought into contact with the surface, in the non-imaging region, at the beginning of the cleaning cycle, using eccentrics. As the surface moves, the first brush in contact with the surface cleans residual toner from the imaging area, while the second brush is sequentially brought into contact with the surface in the non-imaging region. After the cleaning cycle is complete, the first brush coupled to an eccentric gear is retracted from the surface, in the non-imaging region. As the surface continues to move, the second brush also coupled to an eccentric gear, now in the non-imaging region, is retracted from the surface. Then, development of the image on image begins. The brushes are sequentially retracted using a two-level gear, one gear being 90 degrees out of phase with the other, to drive the eccentric gears of the brushes via idler gears. Each gear of the two level gear has a circumference which includes two 90 degree segments with gear teeth and two 90 degree segments with blank zones. The location of the 90 degree segments in conjunction with the eccentric brush gear determine retraction and engagement of the brushes and the sequential timing of these actions.

16 Claims, 5 Drawing Sheets

SEQUENCED CLEANER RETRACTION METHOD AND APPARATUS

CROSS REFERENCE

Cross reference is made to and priority is claimed from U.S. patent application Ser. No. 08/341,735 entitled "Retraction Of Cleaner Backers To Enable Disengagement Of The Cleaner From The Photoreceptor For Image On Image, Multi-pass Color Development", in the name of Bruce E. Thayer, et al., assigned to the same assignee as the present application and filed concurrently herewith.

BACKGROUND OF THE INVENTION

This invention relates generally to a cleaning method, and more particularly, concerns a method for sequenced retraction of the cleaner from the photoreceptor surface.

In the image on image, multi-pass color development process, four layers of color toner (black, cyan, yellow and magenta) are developed onto the photoreceptor before transfer to paper. A separate cycle of the photoreceptor is required to accomplish the development of each color toner layer. To avoid disturbance of these images as the color toner layers are being developed, the cleaning elements must be disengaged from the photoreceptor surface until after the four toner layers have been developed and transferred to paper. After the toner image has been transferred to the paper the cleaning elements must be re-engaged to the photoreceptor to clean any residual toner which failed during transfer. In order to maintain a high productivity level, the cleaning elements should disengage and engage the photoreceptor within the space of the interdocument zones. This requires that the disengagement and engagement occur over fairly short time periods which will depend on the length of the interdocument zone and on the photoreceptor process speed.

Several copiers presently use the multi-pass process before a single transfer step. The Konica 9028 machine uses a blade cleaner which is retracted from the photoreceptor drum while the color images are being developed. The Panasonic FP-C1 machine uses a single electrostatic brush cleaner which is retracted by a cam from the drum photoreceptor. The Sharp CX7500 machine uses an intermediate belt and a dual blade cleaner which is retracted from the photoreceptor belt by a solenoid during color image development. The primary, high load, blade is also retracted when the photoreceptor seam passes under the blade to avoid a motion quality disturbance.

The following disclosure may be relevant to various aspects of the present invention and may be briefly summarized as follows:

U.S. Pat. No. 4,669,864 to Shoji et al. discloses an image forming apparatus having a cleaning device arranged on the outer periphery of an image retainer, and bringing the device into and out of abutment against the image retainer, wherein the cleaning device comprises a first cleaning member and a second cleaning member arranged downstream of the first cleaning member in the moving direction of the surface of the image retainer. A cleaning operation of the second cleaning member against the image retainer is conducted according to a time at which the cleaning operation of the first cleaning member against the image retainer is conducted.

SUMMARY OF INVENTION

Briefly stated, and in accordance with one aspect of the present invention, there is provided a method for cleaning particles from a surface. This method comprises the steps of: developing a plurality of different color images in superimposed registration to form a composite color image on the surface; transferring the composite color image from the surface to a medium; using eccentric gears to step a first brush and a second brush, sequentially, into contact with the surface, to remove particles from the surface after the transferring step; and using the eccentric gears to retract the first brush and the second brush, sequentially from the surface before the developing step.

Pursuant to another aspect of the present invention, there is provided an apparatus for cleaning particles, from a moving surface, remaining after image transfer from the surface. The apparatus comprises two eccentric gears including a first eccentric gear and a second eccentric gear. The apparatus comprises two cleaning brushes, including a first brush, having the first eccentric gear coupled thereto, and a second brush, having the second eccentric gear coupled thereto. Also included are: two idler gears including a first idler gear drivingly coupled to the first eccentric gear and a second idler gear drivingly coupled to the second eccentric gear; a two level gear having a first level gear drivingly coupled to the first idler gear, and a second level gear drivingly coupled to the second idler gear, the first level gear being out of phase with the second level gear; and a motor to drive the two level gear.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 5:
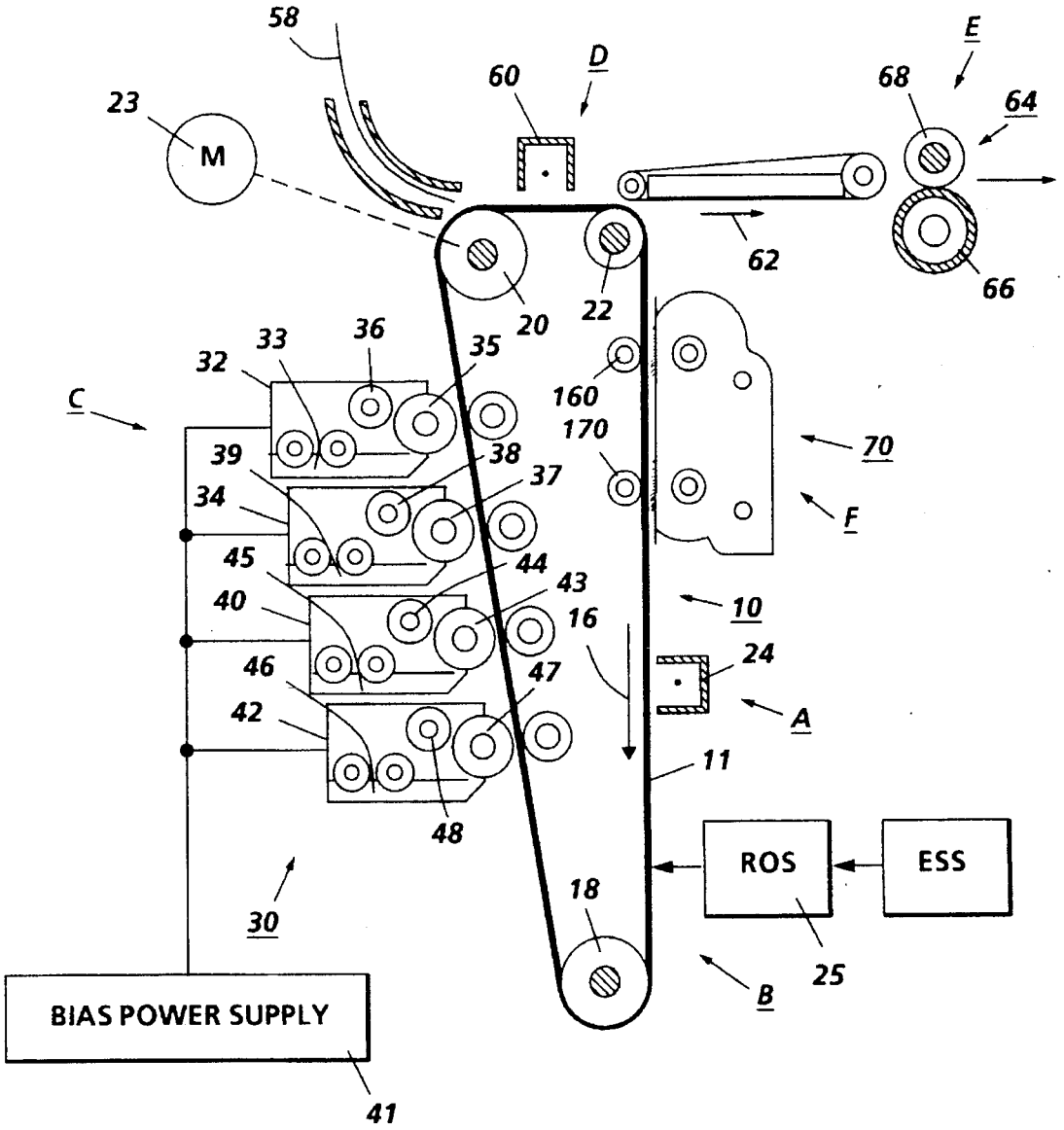
FIG. 5 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 5 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement pass charging station A, and exposure station B, developer stations C, transfer station D, fusing station E and cleaning station F. Belt 10 moves in the direction of arrow 16 to advance successive portions thereof sequentially through the various processing stations disposed a bout the path of movement thereof. Belt 10 is entrained about a plurality of rollers 18, 20 and 22, the former of which can be used to provide suitable tensioning of the photoreceptor belt 10. Motor 23 rotates roller 18 to advance belt 10 in the direction of arrow 16. Roller 20 is coupled to motor 23 by suitable means such as a belt drive.

As can be seen by further reference to FIG. 5, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase depending upon the number of colors, i.e. here four colors are referred to, thus, there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that development housings 32, 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer station D from a supply tray, not shown. Sheets are fed from the tray by a sheet feeder, also not shown, and advanced to transfer station D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush or other type of cleaning system 70. The cleaning system is supported under the photoreceptive belt by two backers 160 and 170.

The multi-pass (e.g. four passes for four colors) single transfer process requires that the cleaner function be disabled, while different color toners are sequentially built up on the photoreceptor. Mid-volume family (i.e. MVF) machine applications normally require a dual electrostatic brush (ESB) cleaner to meet motion quality (MQ) goals that a retracting blade cleaner cannot meet. Also, a retracting dirt problem (at 3 o'clock) occurs with a blade cleaner that is eliminated in a dual ESB cleaner. (i.e. In a 3 o'clock doctor blade cleaner, the toner build up that occurs at the cleaning edge falls downward when the blade is retracted. This toner build up does not occur with an ESB cleaner.)

However, the retraction method of a dual electrostatic brush cleaner is complicated in comparison with the retracting method of a single cleaner (e.g. blade, brush). Especially, when more than one cleaner must be retracted in the interdocument zone, and the interdocument zone (i.e. ID zone or non-imaging region) can only accommodate one cleaner (e.g. a brush due to it's diameter) at a time. In the present invention, the brushes are mounted with eccentrics to provide quicker retraction of the photoreceptor from the brushes than would occur moving the entire cleaner. Also, by taking advantage of the "dwell" period of the eccentrics, the brushes can be individually stepped around the interdocument (ID) zone using a single driver. The "dwell period" is that portion (90°) of the eccentric rotation where the brush motion is mostly parallel to the photoreceptor. One brush moves largely perpendicular to the photoreceptor and the other parallel for each 90 degree rotation of the drive gear. This sequencing minimizes the photoreceptor footprint used for retraction.

Four main concepts were analyzed and evaluated to determine the benefits of the present invention. They are: minimizing a wasted footprint on the photoreceptor; providing good photoreceptor motion quality; not effecting cleaning reliability or toner emissions; and providing low cost and low risk.

The "sequenced brush retraction" method of the present invention has advantages over retracting the photoreceptor away from the cleaner, or retracting the entire cleaner. Photoreceptor retraction has promise but when the space available inside the photoreceptor module is limited, retraction of the photoreceptor backers is difficult. Also, motion quality questions arise relative to the stringent ±0.25% photoreceptor velocity variation goal. Retraction feed was believed limited by tension roll response time, giving a larger footprint.

Figure 1:
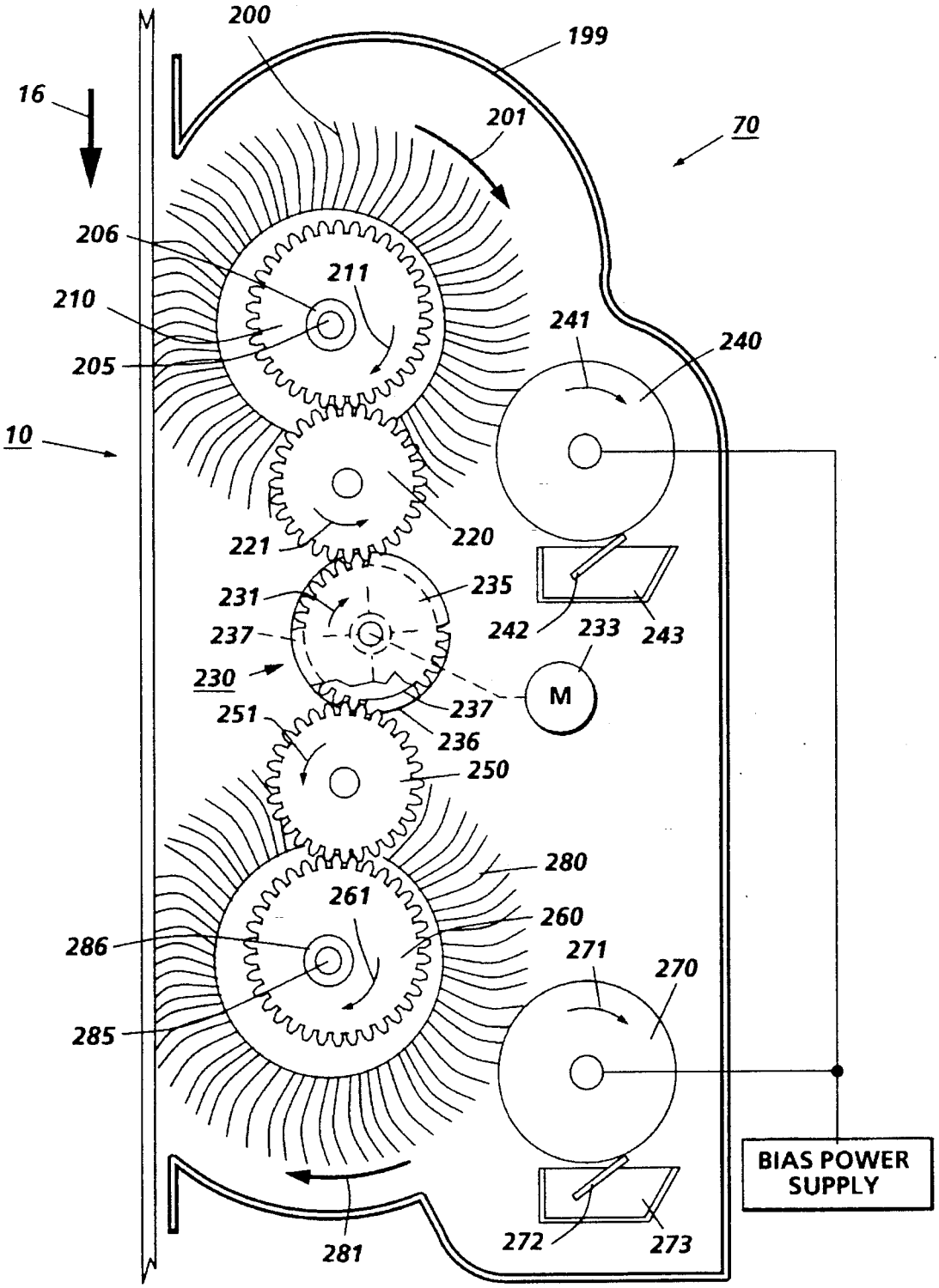
FIG. 1 is a schematic elevational frontal view of the present invention a dual brush cleaner system.

Reference is now made to FIG. 1, which shows the frontal view of the cleaner brushes 200, 280, partially enclosed in housing 199, and engaged with the photoreceptor belt 10 during a cleaning cycle in the image-on-image process. The dual electrostatic brushes 200, 280 rotate in the "against" direction (shown by arrows 201 and 281) of the photoreceptor belt 10 shown by arrow 16. The brushes 200, 280 are adjacent to one another with one brush 200 being located upstream from the other brush 280, in the direction of motion of the photoreceptor belt 10 shown by arrow 16. Mounted on the brush shafts 205, 285 by bearings 206, 286, respectively, are eccentric gears 210, 260 capable of rotation. (The eccentric gears are rotated about a point off center from the center of the brush.) The circumference of the eccentric gears 210, 260 comprise gear teeth for contact with the gear teeth along the circumference of the idler gears 220, 250. The idler gears 220, 250 rotate in the directions shown by arrows 221 and 251, respectively, (i.e. opposite the direction of motion 211, 261 of the eccentric gears 210, 260.) Located between the two idler gears 220, 250 in rotating contact therewith, is the two level gear 230 driven by a motor 233. The two level gear rotates in the direction shown by arrow 231.

With continued reference to FIG. 1, brush fibers are cleaned by biased detoning rolls 240, 270. The biased detoning rolls 240, 270 attract toner particles from the brush fibers to the surface of the detoning rolls 240, 270. The detoning rolls 240, 270 rotate in the direction shown by arrows 241, 271. The surface of the detoning rolls 240, 270 are cleaned by scraper blades 242, 272, respectively, shown here in the doctoring mode. The toner removed by the scraper blades 242, 272 are collected in waste containers 243, 273, respectively.

Continuing reference to FIG. 1, in addition to a desired motion perpendicular to the photoreceptor 10, motion parallel to the photoreceptor 10 effects the clearance to the entrance side of the housing 199 and the detoning roll 240. However, the brushes 200, 280 are only rotating for a short period of time under this condition, while the brushes step in and out in sequence. A stepper motor 233 is the favored driver (i.e. moving force) due to reasonably smooth dv/dt (i.e. rate of change in velocity over time) (shock can cause toner clumps to fall out of the cleaner), and holding torque. Another type of motor or a clutch for the main drive are other possibilities for the two level gear 230.

Figure 2:
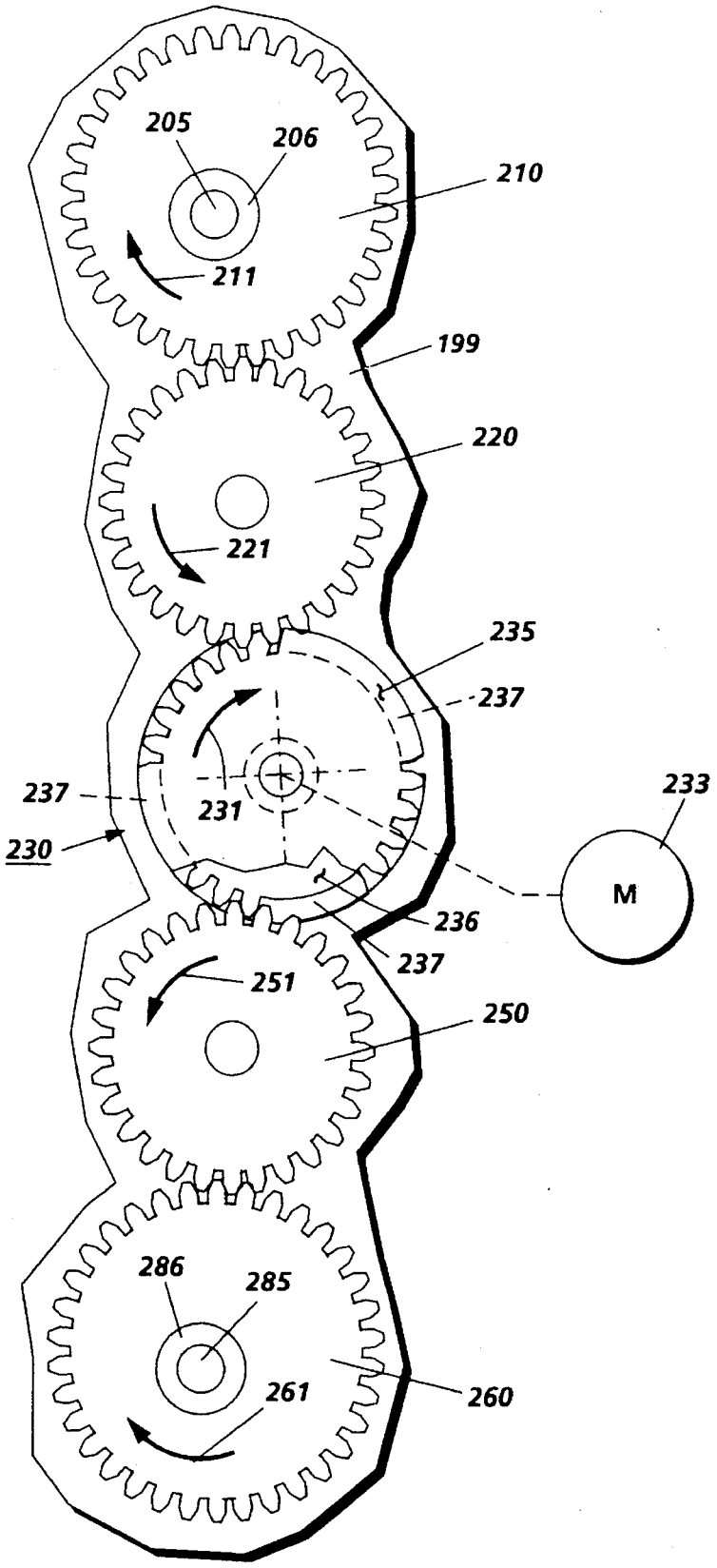
FIG. 2 is a schematic frontal view of the gears of the present invention.

Reference is now made to FIG. 2, which shows a schematic frontal view of the gears of the present invention. A cut away of the two level gear 230 is provided to show the first level gear 235 and the second level gear 236 which comprise the two level gear 230. The first or top level gear 235 of the two level gear 230 rotatingly contacts one of the idler gears 220, causing the idler gear 220 to rotate in the direction shown by arrow 221. The second or bottom level gear 236 of the two level gear 230 rotatingly contacts the other idler gear 250, causing the idler gear 250 to rotate in the direction shown by arrow 251. The first level gear 235 is 90 degrees out of phase with the second level gear 236. Both the first level gear 235 and the second level gear 236 are made up of four 90 degree segments. Two of the four segments have gear teeth along their perimeter and the other two segments do not. The two segments without gear teeth have a recessed area or channel 237 for the gear teeth of the idler gears 220, 250 to pass through without engaging the two level gear 230. The use of a recessed area or channel 237 allows one brush whether retracted or engaged with the surface to remain in it's present position while the other brush is being retracted or engaged. The circumferences of the two level gear 230 are made up of alternating 90 degree segments of gear teeth and channels 237 (i.e. a 90 degree segment with gear teeth is adjacent a 90 degree segment with a channel 237; followed by a 90 degree segment with gear teeth; and a 90 degree segment with a channel 237.)

Figure 3:
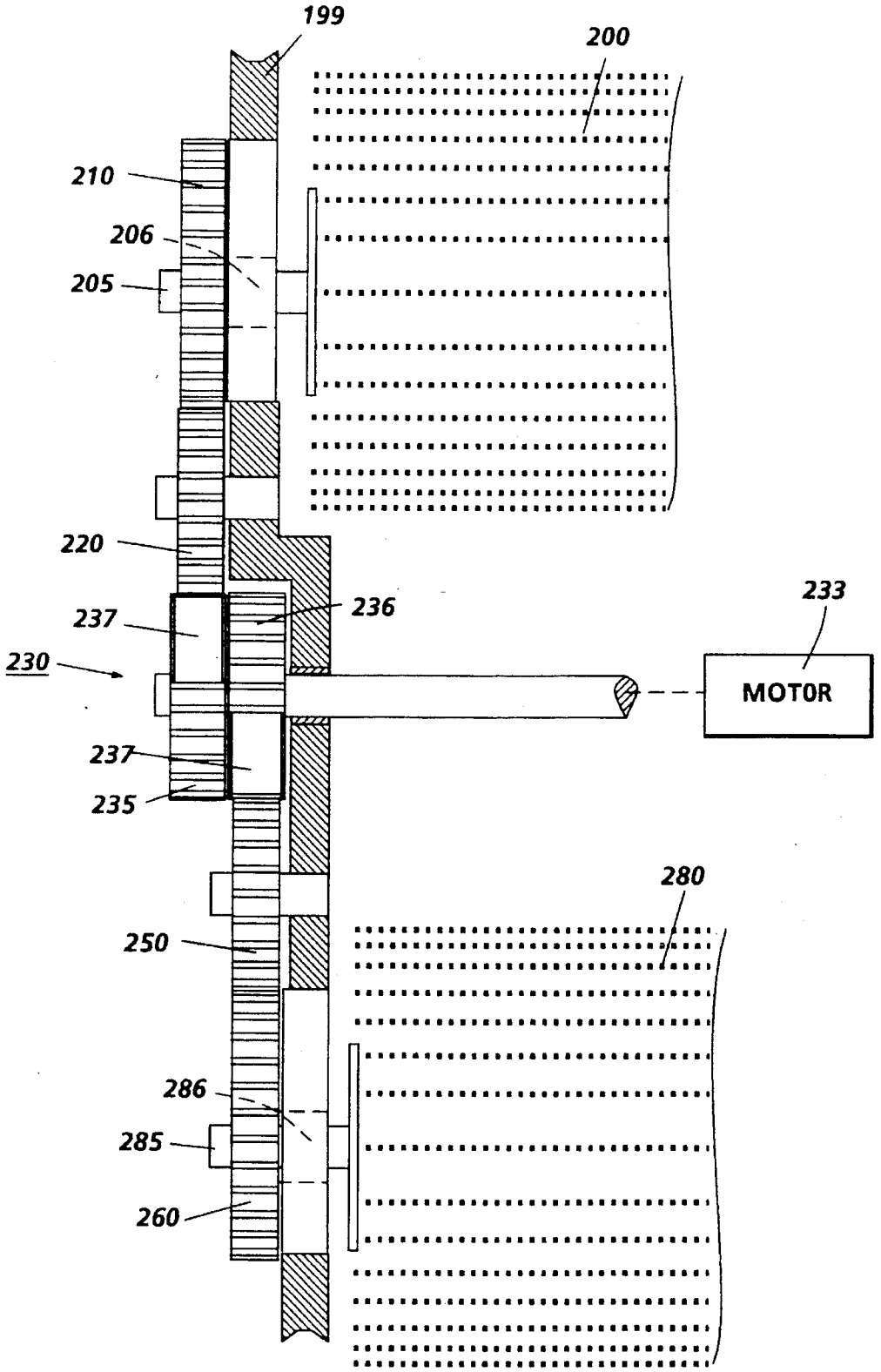
FIG. 3 is a schematic side view of the gears of the present invention in a dual brush cleaner system.

Reference is now made to FIG. 3, which shows a schematic side view of the gear configuration of the present invention. This view clearly shows the first level gear 235 and the second level gear 236 of the two level gear driven by a motor. The 90 degree segments, of the two level gear 230, with gear teeth are shown adjacent to the 90 degree channel segments 237. It should be noted that the eccentric gears 210, 260 must be sized such that they rotate 180 degrees for each 90 degree rotation of the two level gear.

Figure 4A:
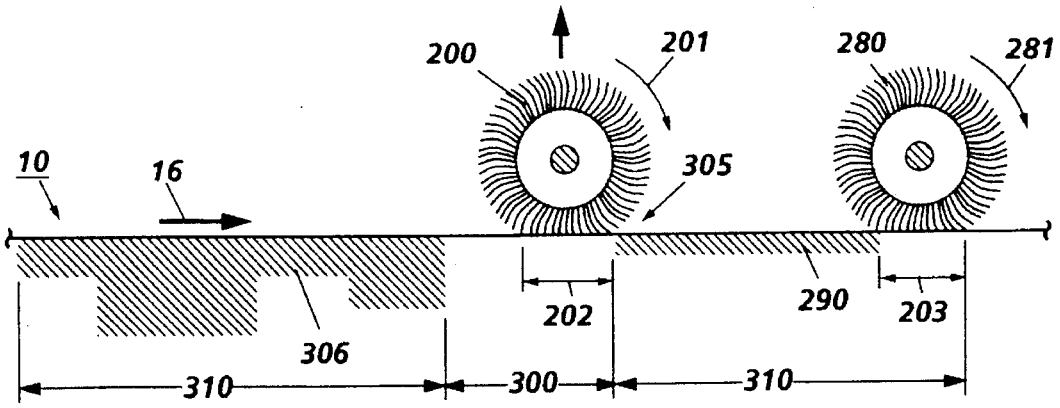
FIG. 4A is a schematic elevational view of both brushes engaged with the surface.
Figure 4B:
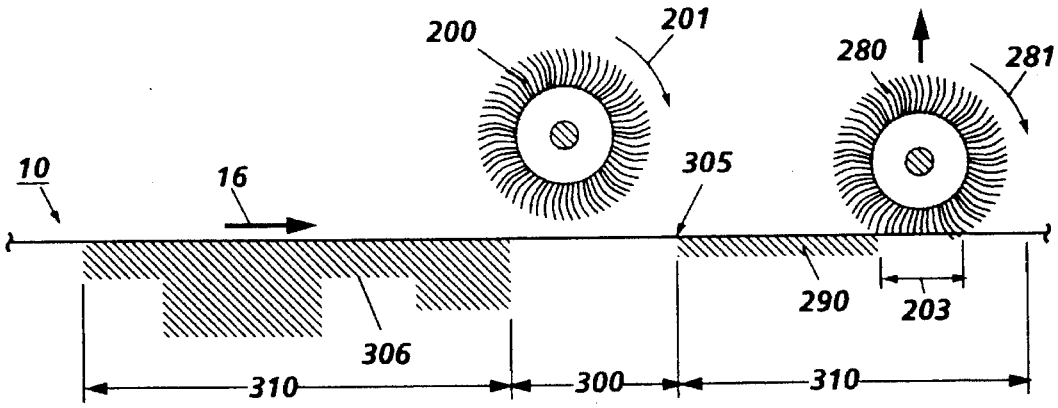
FIG. 4B is a schematic elevational view of the sequenced brush retraction of the first brush, in the direction of motion of the photoreceptor, from the non-imaging region of the surface while the second brush remains in cleaning contact with the surface in the imaging region.
Figure 4C:
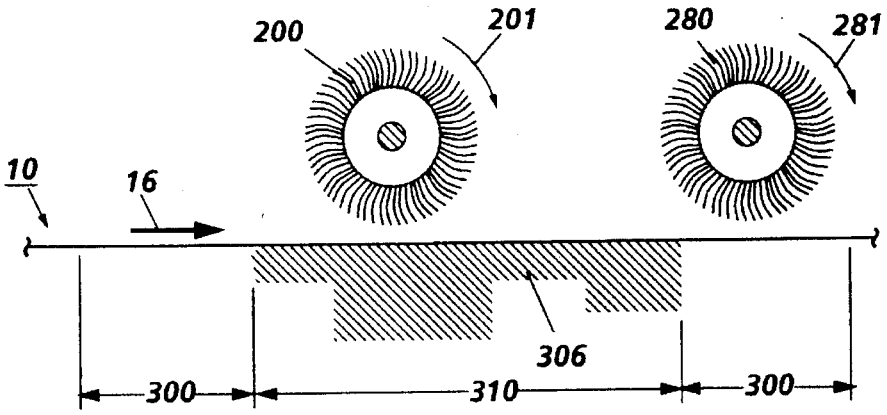
FIG. 4C is a schematic elevational view of the sequenced brush retraction of the second brush, in the direction of motion of the photoreceptor, from the non-imaging region of the surface while the first brush remains retracted over the developing image.

Reference is now made to FIGS. 4A, 4B and 4C, which shows the schematic elevational view of the stepping sequence of the brush cleaner sequence retraction method. The cleaning cycle occurs after the developed image on image is transferred to a paper sheet or another medium. Referring now to FIG. 4A which shows a schematic elevational view of both brushes 200, 280 engaged with the surface. In this view, the cleaning cycle is coming to an end and the first image development pass 306 of one color has begun in the imaging region 310. Thus, the first brush 200, upon reaching the interdocument zone (non-imaging region) of the surface, begins to retract, after the tail end of the residual toner image 290 passes the cleaner nip 202 of the first brush 200. The sequence retraction method occurs using the gears described in FIGS. 1 and 2.

With continued reference to FIG. 4A, the sequence retraction method of the present invention has a single driver for retracting both brushes 200, 280 in sequence to step around the interdocument zone 300, by taking advantage of the eccentric gear characteristics (See FIGS. 1 and 2). The gear train (i.e. gears 230, 220, 210, 250, 260) drives the eccentrics to both brushes 200, 280 from a single prime mover (e.g. motor, solenoid or clutch). The stepping of the brushes 200, 280 in proper sequence is achieved by the phase difference in the eccentrics and a two level gear on the driver. Each level (i.e. first and second) of the two level gear have a circumference comprised of two 90 degree segments with gear teeth thereon and two 90 degree segments with blank zones. The blank zones are channels or grooves in the 90 degree segments of the two level gear circumference that allow the gear teeth of the idler gears to rotate through without engaging the two level gear in these blank zones. Thus the eccentric gear of the brush associated with the blank zone is not driven causing the brush with the blank zone gear to remain in the same position (i.e. retracted or engaged) relative to the surface as the other brush (i.e. associated with the two level gear segment having teeth) is moved into position (i.e. retracted or engaged). The circumference, of each level of the two level gear, has alternating adjacent 90 degree segments. For example, a 90 degree segment having gear teeth is located between two 90 degree segments having blank zones.

Reference is now made to FIG. 4B, which shows a schematic elevational view of the sequenced brush retraction of the first brush 200, in the direction of motion of the photoreceptor 10, from the non-imaging region 300 of the surface while the second brush 280 remains in cleaning contact with the surface in the imaging region 310. The second brush 280, upon reaching the interdocument zone (non-imaging region) 300 of the surface, will begin to retract (see FIG. 4C), after the tail end 305 of the residual toner image 290 passes the cleaner nip 203 of the second brush 280. The sequence retraction method occurs using the gears described in FIGS. 1 and 2.

With continued reference to FIG. 4B, the first 90 degree segment (i.e. driver of the first level gear with teeth engages the idler gear which in turn engages the eccentric gear (see FIG. 1)) lifts the first brush 200 from engagement with the surface to retraction from the surface of the photoreceptor 10, prior to the first brush 200 entering the imaging region 310, where the first pass of the color image 306 in development has occurred. The second brush 280 remains engaged with the surface because it's drive gear (second level gear 90 degree segment) has no teeth. This allows the second brush 280 to clean the residual image 290 from the imaging region 310 of the surface.

Continuing the stepping sequence, reference is now made to FIG. 4C which shows a schematic elevational view of the sequenced brush retraction of the second brush 280, in the direction of motion of the photoreceptor 10, from the non-imaging region 300 of the surface while the first brush 200 remains retracted over the developing image 306. The second brush 280 begins to retract as the second 90 degree segment (i.e. driver of the second level gear with teeth engages the idler gear which in turn engages the eccentric gear (see FIG. 1) lifts the second brush 280 from engagement with the surface when the tail end of the residual image 290 passes the cleaning nip 203 completely. The second brush 280 enters the non-imaging region 300 at this point. The first brush 200 remains retracted from the surface because it's drive gear (first level gear 90 degree segment) has no teeth.

The stepping sequence continues as the first and second level gears are rotated through their third and fourth 90 degree segments. The third 90 degree segment, of the first level gear of the two-level gear, returns the first brush back into engagement with the surface, after the color images have been transferred, and the first brush enters the non-imaging region. (The third 90 degree segment of the first level gear has teeth for engaging the idler gear for the first brush which in turn engages the eccentric gear of the first brush, thus moving the brush into contact with the photoreceptor.) Simultaneously, the second brush remains retracted away from the photoreceptor because the third 90 degree segment, of the second level gear, has no teeth for movement of the second brush. The fourth 90 degree segment of the second level gear of the two level gear has gear teeth to return the second brush back into engagement with the surface, as the second brush enters the non-imaging region of the surface. Simultaneously, the fourth 90 degree segment of the first level gear of the two level gear does not have teeth, thus, the first brush remains engaged with the surface.

The system contains a "brake" to prevent rotation when the brushes are left in the down position which is the position where they are in contact with the photoreceptor surface. A home sensor on the eccentric gear is needed for occasional initialization. The retraction speed goal is 90 degrees in <(less than or equal to) 0.080 seconds, giving a footprint of 40 mm (at 10 ips photoreceptor velocity) which should still fit within the planned 50 mm interdocument zone with timing variability. (Note: The machine speed is approximately 65 ppm.)

The brush rotation stops when the brushes retract to avoid toner emissions. Braking and retraction can go on simultaneously, since at the anticipated speed of less than 100 rpm, the brush will only make a fraction of a revolution. The detoning rolls can also be stopped, but this is not essential. The detoning roll interference with the brush varies with eccentric rotation, but only significantly during brush transients (i.e. moving the brush up and down via the two level gear). The brush to wall clearance approximately equal to eccentricity must be provided to prevent a large interference with the brush during the retracted position. The brush drive must be flexible to allow for the movement of the brush.

An advantage of the present invention, is that only the brushes are retracted into the cleaner housing allowing the use of one housing rather then the use of two housings which is required in prior art applications that retract the cleaner and the cleaner housing. This also reduces the cost of the cleaner system. Another advantage of the present invention is that the low inertia of the brushes, eccentrics and gears gives the quickest retraction time and also minimizes vibrations transmitted to the frame. There are also no holes to seal, as there would be if the brush shafts moved along slots. The blade/detoning roll area is not affected nor are the augers, if they are used. This preserves close to the normal cleaning reliability because complications are avoided such as drives that have to move with the detoning rolls and augers.

In recapitulation, the present invention discloses an apparatus and method using eccentrics, driven by a two-level gear, to sequentially retract and engage dual electrostatic brushes in the non-imaging area of the surface. The brushes are sequentially retracted using a two-level gear, one gear being 90 degrees out of phase with the other gear. The circumference of each of the gears is made up of two 90 degree segments with gear teeth and two 90 degree segments with a channel. The location of the 90 degree segments in conjunction with the eccentric brush gear and the idler gears determine retraction and engagement of the brushes and the sequential timing of these actions.

It is therefore apparent, that there has been provided, in accordance with the present invention, a sequence cleaner retraction method that fully satisfies the aims and advantages herein before set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A method for cleaning particles from a surface, comprising:

developing a plurality of different color images in superimposed registration to form a composite color image on the surface;

transferring the composite color image from the surface to a medium;

using eccentric gears to step a first brush and a second brush, sequentially, into contact with the surface, to remove particles from the surface after said transferring step; and using the eccentric gears to retract the first brush and the second brush sequentially from the surface before said developing step.

2. The method of claim 1, wherein said first mentioned using step, comprises:

engaging the first brush with a non-imaging region of the surface;

moving the non-imaging region of the surface past the first brush such that the first brush contacts an imaging region and the second brush moves into the non-imaging region having a space between the second brush and the surface; and moving the second brush into contact with the surface in the non-imaging region of the surface.

3. The method of claim 2, wherein the engaging step comprises rotating a gear having a first level gear and a second level gear, said first level gear being 90 degrees out of phase with said second level gear.

4. The method of claim 3, wherein the engaging step comprises moving the first brush into contact with the surface in the non-imaging region using said first level gear, and the step of moving the second brush into contact with the surface using said second level gear.

5. The method of claim 4, wherein said second mentioned using step comprises rotating said first level gear moving the first brush out of contact with the surface in the non-imaging region and sequentially, rotating said second level gear moving the second brush out of contact with the surface in the non-imaging region.

6. An apparatus for cleaning particles, from a moving surface, remaining after image transfer from the surface, comprising:

two eccentric gears including a first eccentric gear and a second eccentric gear;

two cleaning brushes including a first brush, having said first eccentric gear coupled thereto, and a second brush, having said second eccentric gear coupled thereto;

two idler gears including a first idler gear drivingly coupled to said first eccentric gear and a second idler gear drivingly coupled to said second eccentric gear;

a two level gear having a first level gear drivingly coupled to said first idler gear, and a second level gear drivingly coupled to said second idler gear, said first level gear being out of phase with said second level gear; and a motor to drive said two level gear.

7. An apparatus as recited in claim 6, wherein said brushes sequentially engage the surface after image transfer to remove the particles from the surface, and sequentially retract from the surface after cleaning the particles from the surface.

8. An apparatus as recited in claim 7, wherein each of said first level gear and said second level gear comprise four adjacent segments including two 90° segments having gear teeth therealong, and two 90° segments having a channel therealong.

9. An apparatus as recited in claim 8, wherein two 90° segments with gear teeth are interposed between the 90° segments with the channel.

10. An apparatus as recited in claim 9, wherein said first level gear is 90° out of phase with said second level gear.

11. An apparatus as recited in claim 10, wherein said two level gear is located between said first idler gear having gear teeth and said second idler gear having gear teeth, said first level gear drivingly contacting said first idler gear and said second level gear drivingly contacting said second idler gear.

12. An apparatus as recited in claim 11, wherein the surface comprises an imaging region and a non-imaging region.

13. An apparatus as recited in claim 12, wherein one of the 90° segments with gear teeth of the first level gear drivingly contacts said first idler gear causing said first idler gear to drivingly engage said first eccentric gear to retract said first brush from contact with the surface in the non-imaging region after the remaining particles of the transferred image have been removed from the surface and one of the 90° segments with the channel of the second level gear rotates into position about said second idler gear such that said second idler gear remains stationary and said second eccentric gear remains stationary causing said second brush to remain in contact with the surface.

14. An apparatus as recited in claim 13, wherein one of the 90° segments with the channel of the first level gear moves into position about said first idler gear such that said first idler gear remains stationary and said first eccentric gear remains stationary causing said first brush to remain out of contact with the surface and one of the 90° segments with gear teeth of the second level gear moves into driving contact with said second idler gear causing said second idler gear to drivingly engage said second eccentric gear to retract said second brush from contact with the surface in the non-imaging region.

15. An apparatus as recited in claim 14, wherein one of the 90° segments with gear teeth of the first level gear drivingly contacts said first idler gear causing said first idler gear to drivingly engage said first eccentric gear to engage said first brush into contact with the surface, in the non-imaging region, after the image has been transferred and one of the 90° segments with the channel of the second level gear rotates into position about said second idler gear such that said second idler gear remains stationary and said second eccentric gear remains stationary causing said second brush to remain retracted from the surface.

16. An apparatus as recited in claim 15, wherein one of the 90° segments with the channel of the first level gear moves into position about said first idler gear such that said first idler gear remains stationary causing said first brush to remain engaged with the surface and one of the 90° segments with gear teeth of the second level gear moves into driving contact with said second idler gear causing said second idler gear to drivingly engage said second eccentric gear to retract said second brush into contact with the surface in the non-imaging region.

* * * * *